US008502737B2

(12) United States Patent
Kawata et al.

(10) Patent No.: US 8,502,737 B2
(45) Date of Patent: Aug. 6, 2013

(54) COMMUNICATION DEVICE

(75) Inventors: Toshihiko Kawata, Funabashi (JP); Shinichi Nakada, Yamato (JP); Masaki Noji, Kawasaki (JP)

(73) Assignee: Kyocera Corporation, Kyoto (JP)

( * ) Notice: Subject to any disclaimer, the term of this patent is extended or adjusted under 35 U.S.C. 154(b) by 740 days.

(21) Appl. No.: 12/294,873

(22) PCT Filed: Mar. 28, 2007

(86) PCT No.: PCT/JP2007/056641
§ 371 (c)(1),
(2), (4) Date: May 28, 2010

(87) PCT Pub. No.: WO2007/114165
PCT Pub. Date: Oct. 11, 2007

(65) Prior Publication Data

US 2010/0231459 A1 Sep. 16, 2010

(30) Foreign Application Priority Data

Mar. 28, 2006 (JP) ..... 2006-087466
Mar. 28, 2006 (JP) ..... 2006-087467

(51) Int. Cl.
*H01Q 1/24* (2006.01)

(52) U.S. Cl.
USPC ..... 343/702; 343/700 MS

(58) Field of Classification Search
USPC ..... 343/700 MS, 702
See application file for complete search history.

(56) References Cited

U.S. PATENT DOCUMENTS 6,476,767 B2 * 11/2002 Aoyama et al. ..... 343/700 MS
6,873,292 B2 * 3/2005 Yoo et al. ..... 343/702
7,280,075 B2 * 10/2007 Koyama et al. ..... 343/702
7,301,499 B2 * 11/2007 Shin et al. ..... 343/700 MS
8,174,452 B2 * 5/2012 Ayala Vazquez et al. ..... 343/702

FOREIGN PATENT DOCUMENTS

JP 09064764 A 3/1997
JP 09289471 A 11/1997
JP 10126146 A 5/1998
JP 10173434 A 6/1998

(Continued)

OTHER PUBLICATIONS

Japanese language office action dated Aug. 17, 2010 and its English language translation for corresponding Japanese application 2006087466 lists the references above.

(Continued)

*Primary Examiner* — Tho G Phan
(74) *Attorney, Agent, or Firm* — DLA Piper LLP (US)

(57) ABSTRACT

A communication device which solves a new problem, that is, a power amplifier has oscillation caused by providing a conductive body which reduces the effects of the noise on a chip antenna, includes: a chip antenna which catches radio waves of a desired frequency; an RF circuit which is implemented on a printed wiring board and which converts received signals input from the chip antenna to a low frequency; a digital circuit which is implemented on the printed wiring board and which demodulates the received signals in a low frequency input from the RF circuit; a conductive body which is extended between the chip antenna and the digital circuit while being maintained at a certain height from the printed wiring board, and which has an end connected to a ground conductive body of the printed wiring board; and a radio wave absorption body which is attached to the conductive body.

6 Claims, 7 Drawing Sheets

FOREIGN PATENT DOCUMENTS

| | | | |
|---|---|---|---|
| JP | 10270932 | A | 10/1998 |
| JP | 2000307339 | A | 11/2000 |
| JP | 2001352208 | A | 12/2001 |
| JP | 2002217631 | A | 8/2002 |
| JP | 2005167821 | A | 6/2005 |

OTHER PUBLICATIONS

Japanese language office action dated Aug. 17, 2010 and its English language translation for corresponding Japanese application 20060874467 lists the references above.

International Search Report for corresponding PCT application PCT/JP2007/056641 lists the references above.

Japanese language office action dated Aug. 17, 2010 and its English language translation for corresponding Japanese application 2006087467.

Chinese language office action dated Dec. 15, 2011 and its English language translation issued in corresponding Chinese application 200780010920.X.

* cited by examiner

| Marker | Trace | Type | X Axis | Amplitude |
|---|---|---|---|---|
| 1 | (1) | Freq | 1.791 7 GHz | 17.62 dBm |
| 2 | (1) | Freq | 1.694 2 GHz | -3.81 dBm |
| 3 | (1) | Freq | 1.889 2 GHz | -23.30 dBm |
| 4 | (1) | Freq | 1.986 7 GHz | -41.98 dBm |

| Marker | Trace | Type | X Axis | Amplitude |
|---|---|---|---|---|
| 1 | (1) | Freq | 1.791 7 GHz | 21.41 dBm |
| 2 | (1) | Freq | 1.694 2 GHz | -44.67 dBm |
| 3 | (1) | Freq | 1.889 2 GHz | -44.48 dBm |
| 4 | (1) | Freq | 1.986 7 GHz | -44.17 dBm |

COMMUNICATION DEVICE

CROSS-REFERENCE TO RELATED APPLICATIONS

This application is a national stage of international application No. PCT/JP2007/056641, filed on Mar. 28, 2007, and claims the benefit of priority under 35 USC 119 of Japanese Patent Application No. 2006-087466 and 2006-087467, both filed on Mar. 28, 2006, which are incorporated herein by reference.

TECHNICAL FIELD

1. Field of the Invention

The present invention relates to a communication device.

2. Background Art

In both the past and the present, there are various types of communication devices for wireless communication to external apparatuses such as a base station, for example, there is a type of PC card which is used after insertion into an extended slot of a mobile terminal or a notebook type personal computer (hereinafter, a notebook personal computer).

Such a communication device provides an antenna for establishing a wireless communication to such a base station in order to transmit and receive radio waves, and in recent years, from the view point of an external appearance and cost, a chip antenna which is installed inside the case is used in stead of an antenna which is conventionally used and is extruded outside the case However, in a case of using the chip antenna, due to its characteristics, there is a higher possibility than before in which the chip antenna receives noise generated by devices that are set around and close to the chip antenna, and as a result, there is a problem in which the ability of the chip antenna to receive radio waves of a desired wavelength is deteriorated. The device which is set around and close to the chip antenna is, for example, a digital circuit implemented on a printed wiring board on which the chip antenna is implemented together and the notebook personal computer if the communication device is a PC card type.

There are techniques that reduce the influence of the noise, that are shown in the Patent Documents 1 and 2.

Patent Document 1 shows a technique in which a ground wiring of a high frequency receiver and a ground wiring of a calculation operation circuit are independently provided in order to avoid the noise generated by the calculation operation circuit from being included into the high frequency receiver.

Patent Document 2 discloses a technique applied to a wireless communication card to which a spectrum diffusion method is applied and which includes: a card interface of such as a personal computer; modulation/demodulation means; a spectrum diffusion/opposite diffusion means; and a frequency modulation means, wherein the wireless communication card can be attached to a card slot, and the position of the antenna is set at least 10 cm apart from the personal computer.

[Patent Document 1] Japanese Patent Application, First Publication No. H09-64764

[Patent Document 2] Japanese Patent Application, First Publication No. H09-289471

Even in a case in which the ground wirings are independently provided as shown in the technique described in Patent Document 1, in a practical case it is not possible to achieve sufficient effects if a distance between the ground wirings is not sufficient. With regard to a board of a small device, in many cases, it is difficult to have a sufficient distance between the ground wirings.

In addition, the technique described in Patent Document 2 cannot be applied to a communication device in which the distance between the antenna and the device is necessarily 10 cm or smaller.

The present invention was conceived in order to solve the above-described problem and has an object to reduce the influence of the noise by applying a method with a low cost and without difficulty and to restrain factors which deteriorate the ability of the chip antenna to receive the radio waves.

In addition, the applicant has recognized that, by providing a conductive body which satisfies certain conditions and which is connected to the ground of the printed board, it is possible to reduce the deterioration of the receiving ability due to the noise generated by the digital circuit and the like.

However, there is a new problem in which a transmission state is unstable because a transmission amplifier causes an oscillation after providing the conductive body. With regard to this new problem, it is supposed that the oscillation is caused because of a combination of various conditions and parameters, for example, there are portions of the transmission power amplifier with a low stabilization index due to distribution caused in production steps. In addition, transmission signals are modulated in a high frequency by the RF circuit, supplied to the chip antenna for conducting the electric power amplification by the transmission amplifier and radiated in the air, and here, it is supposed that the transmission power amplifier oscillates because a return transmitted signals loop is formed when the transmission signals are electro-magnetically connected to the transmission power amplifier via the conductive body. In other words, in the conventional technique, there has been an unstable band in which an oscillation is generated in accordance with a combination of various conditions and parameters, and it has been desirable to avoid such an oscillation and achieve a further stable transmission operation.

DISCLOSURE OF INVENTION

The present invention was conceived to solve the above-described problems and has an object to avoid a new problem that is oscillation of the power amplifier caused by providing a conductive body.

In order to solve the above-described problems, the present invention provides a first solution including: a chip antenna which catches radio waves of a desired frequency; an RF circuit which is implemented on a printed wiring board and which converts received signals input from the chip antenna to a low frequency; a digital circuit which is implemented on the printed wiring board and which demodulates the received signals in a low frequency input from the RF circuit; a conductive body which is extended between the chip antenna and the digital circuit while being maintained at a certain height from the printed wiring board, and which has an end connected to a ground conductive body of the printed wiring board; and a radio wave absorption body which is attached to the conductive body.

A second solution is applied which includes; a chip antenna which catches radio waves of a desired frequency and which has an electric length of a ¼ of a wavelength of the radio wave of the desired frequency; an RF circuit which is implemented on a printed wiring board and which converts received signals input from the chip antenna to a low frequency; a digital circuit which is implemented on the printed wiring board and which demodulates the received signals in a low frequency input from the RF circuit; a conductive body which has an electric length of a ¼ of a wavelength of the radio wave of the desired frequency, which is extended between the chip antenna and the digital circuit while being maintained at a certain height from the printed wiring board, and which has an end connected to a ground conductive body of the printed wiring board; and a radio wave absorption body which is attached to the conductive body.

A third solution according to the above-described first and second solutions is applied, in which the conductive body is constituted from a metallic plate of a strip shape, and the radio wave absorption body has a length of at least 2 mm along a lengthwise direction of the conductive body and has the substantially same length as a width of the conductive body along a width direction of the conductive body.

In order to solve the above-described problems, the present invention provides a fourth solution, including; a chip antenna which catches radio waves of a desired frequency; an RF circuit which is implemented on a printed wiring board and which amplifies and converts received signals input from the chip antenna to a low frequency; a digital circuit which is implemented on the printed wiring board and which demodulates the received signals in a low frequency input from the RF circuit; and a conductive body which is extended between the chip antenna and the digital circuit while being maintained at a certain height from the printed wiring board, and which has an end connected to a ground conductive body of the printed wiring board.

A solution is applied solution, that includes: a chip antenna which catches radio waves of a desired frequency and which has an electric length of a ¼ of a wavelength of the radio wave of the desired frequency; an RF circuit which is implemented on a printed wiring board and which amplifies and converts received signals input from the chip antenna to a low frequency; a digital circuit which is implemented on the printed wiring board and which demodulates the received signals in a low frequency input from the RE circuit; and a conductive body which has an, electric length of a ¼ of a wavelength of the radio wave of the desired frequency, which is extended between the chip antenna and the digital circuit while being maintained at a certain height from the printed wiring board, and which has an end connected to a ground conductive body of the printed wiring board.

A sixth solution according to the above-described fourth and fifth solutions is applied, in which the conductive body has a substantially L shape constituted from a metallic member in a strip shape, is curved at a position close to one end which is connected to the ground conductive body, and has a portion between the curved position and another end which is an open end is in parallel to the printed wiring body.

According to the present invention, an oscillation of the power amplifier is avoided by attaching a radio wave absorption body to the conductive body, hence it is possible to solve the new problem, that is an oscillation of the power amplifier, without deteriorating a function of reducing the influence of noises on the chip antenna.

In addition, in accordance with the present invention, by providing the conductive body, it is possible to reduce the degree of the noise that is generated by the closely installed devices and comes into the antenna chip.

Hence, by applying a low cost and easy solution of attaching a conductive body to the existing constitution, it is possible to reduce the influence of the noise and to exclude factors of deteriorating the receiving ability of the chip antenna.

DESCRIPTION OF THE REFERENCE SYMBOLS

Figure 1:
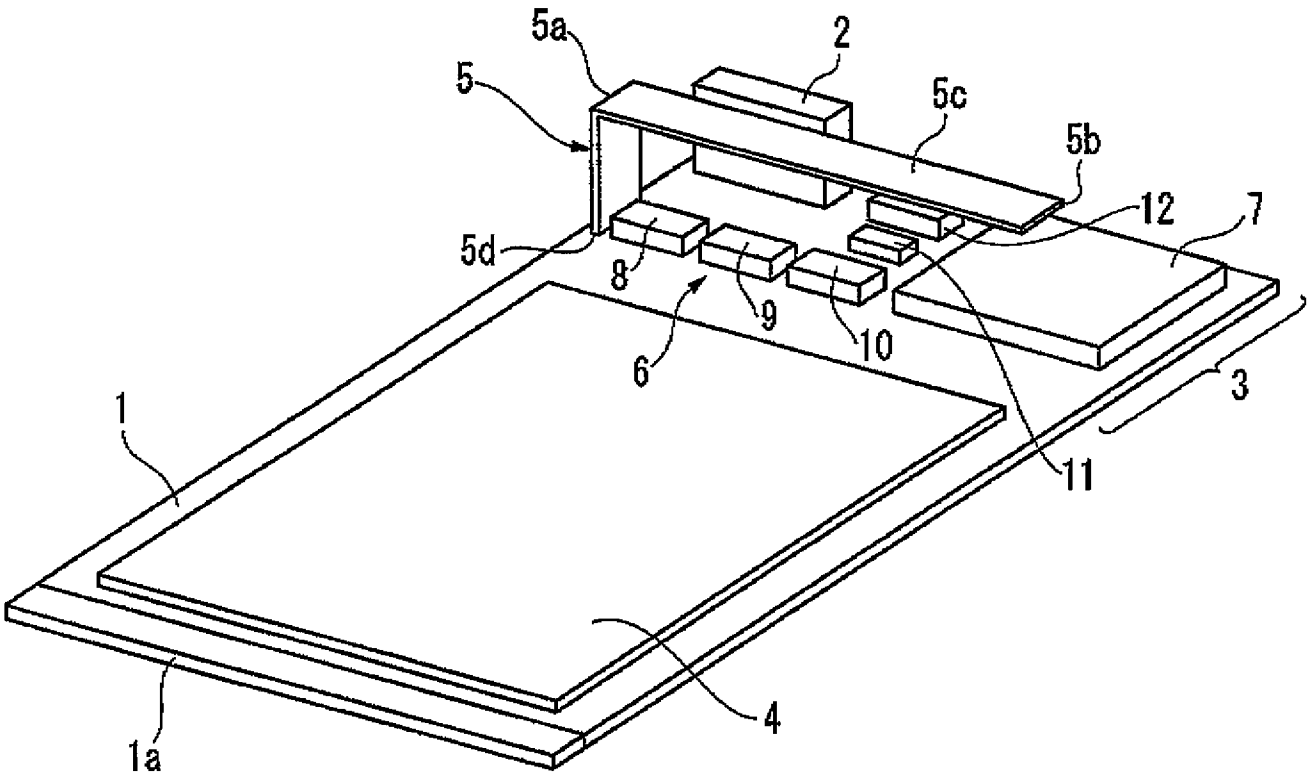
FIG. 1 is a perspective view of an outside of a communication device in a case of applying a conductive body without providing a radio wave absorption body in one embodiment of the present invention.

1 . . . printed wiring board
1*a* . . . connector
2 . . . chip antenna
3 . . . RF circuit
4 . . . digital circuit
5 . . . L shape metallic plate (conductive body)
5*a* . . . curved portion
5*b* . . . end portion
5*c* . . . portion
5*d* . . . end portion
6 . . . transmission portion
7 . . . receiving portion
8 . . . RFSAW filter
9 . . . power amplifier
10 . . . isolator
11 . . . RF switch
12 . . . conductive body filter
13 . . . radio wave absorption body
21 . . . printed wiring board
21*a* . . . connector
22 . . . chip antenna
23 . . . RF circuit
24 . . . digital circuit
25 . . . L shape metallic plate (conductive body)

25*a* . . . curved portion
25*b* . . . end portion
25*c* . . . portion
25*d* . . . end portion

BEST MODE FOR CARRYING OUT THE INVENTION

First Embodiment

Hereinafter, in reference to FIGS. 1-6, one embodiment of a communication device of the present invention is explained. FIG. 1 is a perspective view of the outside of a communication device to which a solution for oscillation of the power amplifier is not applied. The communication device which is used while installed inside the case of a PC card includes: a printed wiring board 1; a chip antenna 2; an RF circuit portion 3; a digital circuit portion 4; and an L shape metallic plate 5 (conductive body). The RF circuit portion 3 has a constitution including a transmission portion 6 and a receiving portion 7, and the transmission portion 6 includes: an RFSAW filter 8; a power amplifier 9; an isolator 10; an RF switch 11; and a conductive body filter 12.

The printed wiring board 1 has a connector 1*a* at one end. The connector 1*a* is connected to a connector inside an extended slot of a notebook personal computer.

On the printed board 1, the chip antenna 2, the RF circuit portion 3 and the digital circuit portion 4 are provided in order from the side of the end opposite the connector 1*a*. In addition, the printed wiring board 1 has a ground conductive body to which the L shape metallic plate 5 is connected.

The chip antenna 2 is implemented so as to have a lengthwise direction which is substantially orthogonal to a direction on which the chip antenna 2, the RF circuit portion 3, and the digital circuit portion 4 are arranged on the printed wiring board 1.

The chip antenna 2 catches the received radio wave and outputs the radio wave as the received signal to the receiving portion 7 of the RE circuit portion 3, and the chip antenna 2 radiates the transmission signal as the transmission radio wave in the air that is input from the transmission portion 6 of the RF circuit portion 3.

The chip antenna 2 has an electric length equals to ¼ of the wavelength of the received radio wave or the transmission radio wave.

The receiving portion 7 of the RF circuit portion 3 converts the input signal (RF signal) input from the chip antenna 2 to a low frequency and outputs it to the digital circuit portion 4. The transmission portion 6 of the RF circuit 3 converts the signal input from the digital circuit portion 4 to the high frequency (to RF signal) and outputs the converted signal to the chip antenna 2.

In a detail explanation of an operation of the transmission portion 6 of the RF circuit 3, a band limitation operation is conducted on the modulated signal input from the digital circuit portion 4 after inputting into the RFSAW filter 8, the signal is input and amplified by the power amplifier 9, the signal is input by the conductive body filter 12 via the isolator 10 and the RF switch 11, and the signal is input by the chip antenna 2.

The digital circuit portion 4 demodulates the signal input from the receiving portion 7 of the RF circuit portion 3 and outputs the signal to the connector 1*a*, and the digital circuit portion 4 modulates the signal input from the connector 1*a* and outputs the signal to the transmission portion 6 of the RF circuit 3.

The L shape metallic plate 5 has a shape in which a portion close to one end of a metallic plate in a strip shape is curved in a substantially orthogonal angle, the end portion 5*d* is connected to the ground conductive body while the portion 5*c* which is between the end portion 5*a* apart from the curved portion 5*a* and the curved portion 5*a* is substantially in parallel to the printed wiring board 1, and the other end portion 5*b* is an open end.

The L shape metallic plate 5 has an electric length equals to an ¼ wavelength of the transmitted/received radio wave. In a case in which the transmission/received frequency of the chip antenna is in the 1.79 GHz band, the L shape metallic plate 5 has an appropriate shape in which, for example, a width is 6 mm, a length of the portion 5*c* is 33 mm that is a length between the end portion 5*b* which is an open end and the curved portion 5*a*, and a length between the curved portion 5*a* and the end portion 5*d* is 5 mm.

The L shape metallic plate 5 is provided in a manner in which the portion 5*c* between the end portion 5*b* which is the open end and the curved portion 5*a* is extended between the chip antenna 2 and the digital circuit portion 4 while maintaining a height or distance from the printed wiring board 1 so as to be 5 mm, and in addition, a length direction of the portion 5*c* is substantially parallel to a length direction of the chip antenna 2.

By providing the above-described L shape metallic plate 5, it is possible to avoid the reduction of receiving ability of the chip antenna 2 due to the noise generated from the devices set around and close to the chip antenna 2, but there is a possibility of a type of the power amplifier 9 having oscillation.

Figure 2:
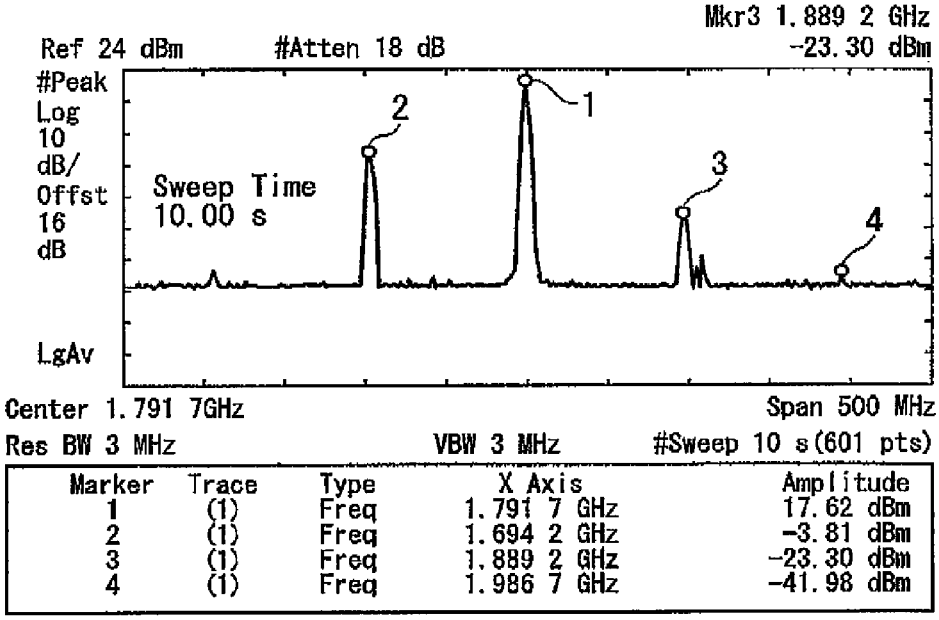
FIG. 2 is a graph showing the transmission spectrum in a case of no oscillation of the power amplifier of the transmission device without attaching the radio wave absorption body to the conductive body in one embodiment of the present invention.

FIG. 2 is a graph showing a transmission spectrum while the power amplifier 9 is oscillating. As show here, when transmitting at a 1.79 GHz band in the above-described constitution, there is an oscillation of approximately 1.7 GHz.

Figure 3:
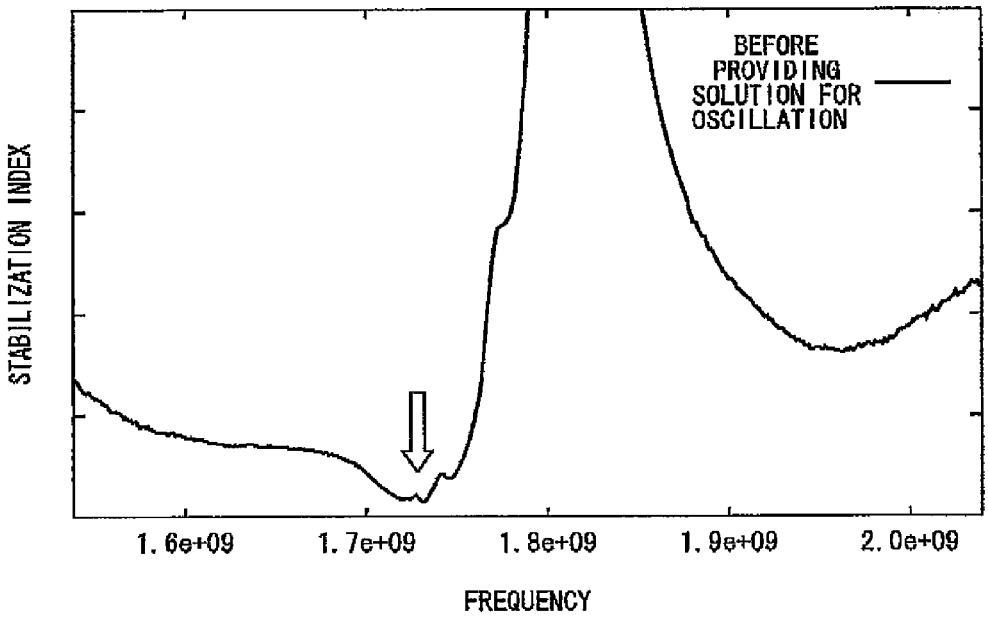
FIG. 3 is a graph showing a stabilization index among the chip antenna, an L shape metallic plate and the power amplifier without the attachment of the radio wave absorption body to the conductive body in one embodiment of the present invention.

FIG. 3 is a graph showing a stabilization index among the chip antenna, an L shape metallic plate and the power amplifier. The stabilization index is called a K factor that is an index showing a stable operation of the amplifier and the like, and is calculated in accordance with the following formula (1) by using an S parameter which shows a transfer characteristic of a circuit.

$$K=(1+|S_{11}S_{22}-S_{12}S_{21}|^2-|S_{11}|^2-|S_{22}|^2)/(2|S_{12}S_{21}|) \quad (1)$$

If K>1, the circuit has a stable operation.

As shown in the graph, the stabilization index is deteriorated at approximately 1.7 GHz because of oscillation of the power amplifier 9.

Figure 4A:
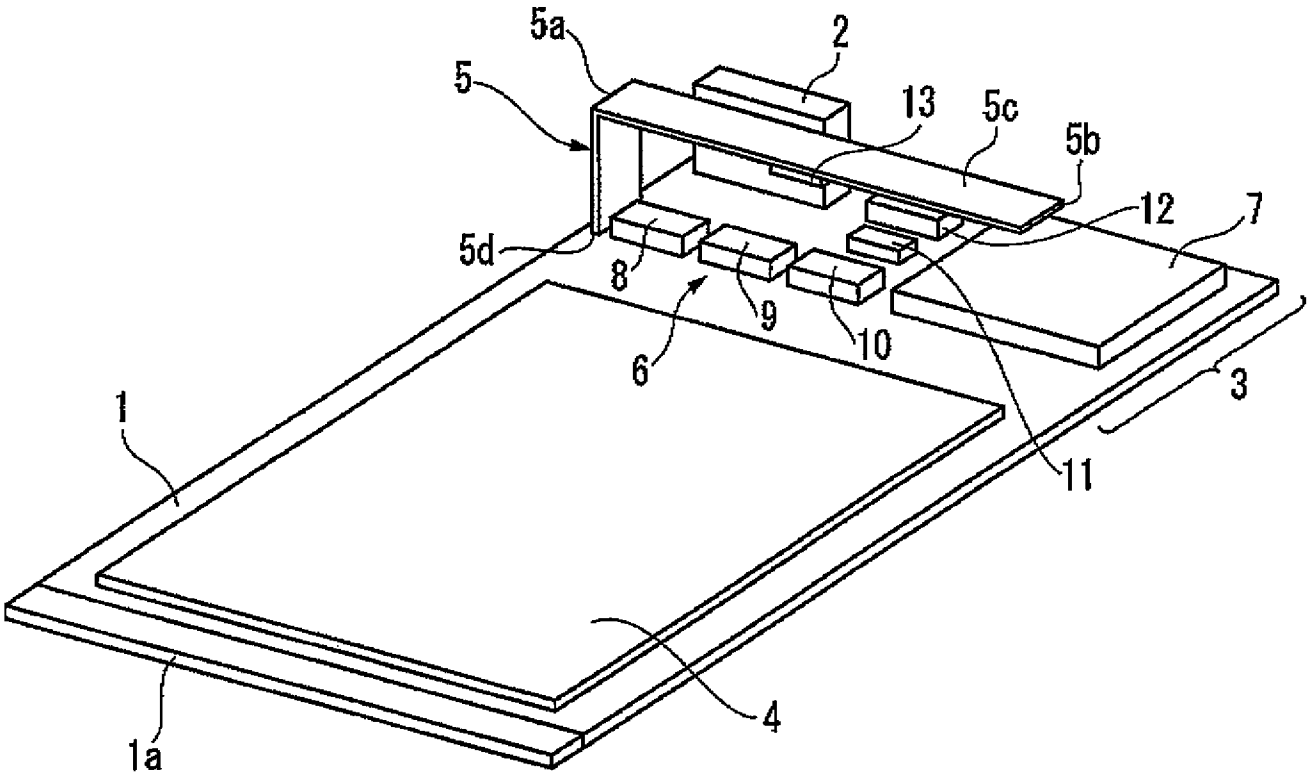
FIG. 4A is a perspective view of the outside of a communication device in one embodiment of the present invention to which a conductive body providing a radio wave absorption body is applied.
Figure 4B:
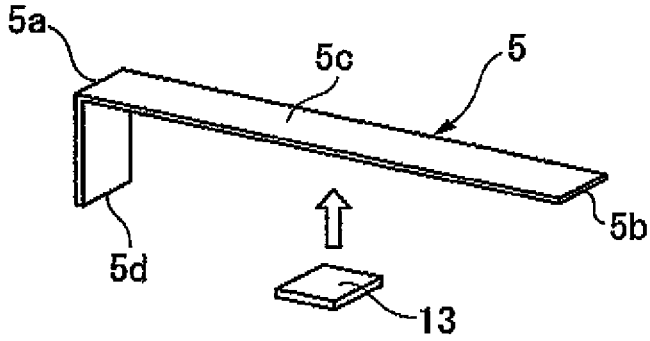
FIG. 4B is a perspective view of a conductive body and a radio wave absorption body in one embodiment of the present invention.

There is a constitution shown in FIGS. 4A and 4B that solves the above-described problem. In the constitution of FIGS. 4A and 4B, the radio wave absorption body 13 is attached to the L shape metallic plate 5.

In FIGS. 4A and 4B, the radio wave absorption body 13 is attached to a surface of the L shape metallic plate 5 that faces the printed wiring board 1 and faces the power amplifier 9, but in a practical implementation, it is possible to provide the radio wave absorption body 13 on other positions of the L shape metallic plate 5, and it is possible to have the same effects.

An appropriate size of the radio wave absorption body 13 is, for example, 5 mm of vertical×5 mm of sides×0.25 mm of thickness. In addition, it is possible to apply various materials to the radio wave absorption body, and for example, the radio wave absorption body made from a sheet of mixture of the synthetic rubber and the metallic magnetism powder is easily handled, hence it is easy to form such a radio wave absorption body into a desired shape and that can be easily attached to the L shape metallic plate 5.

Figure 5:
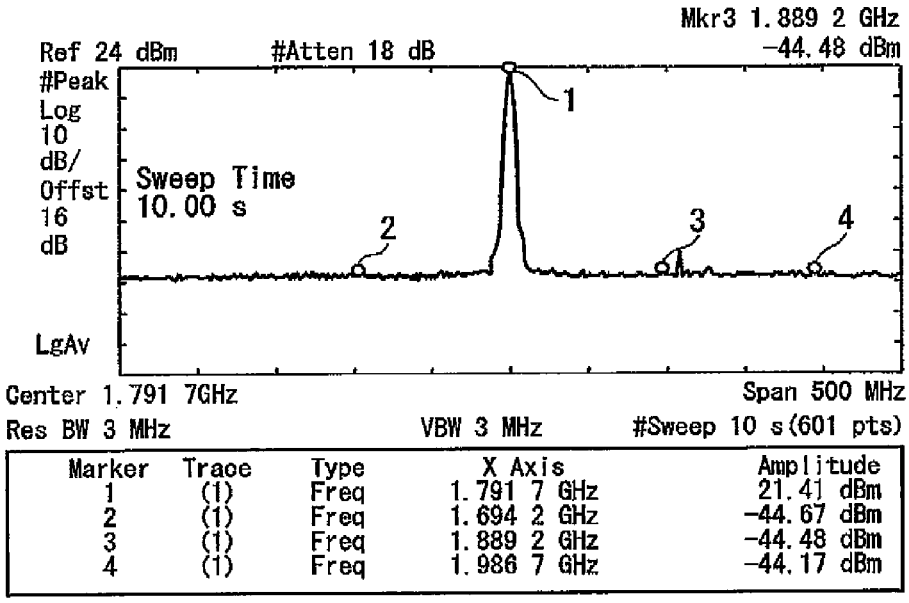
FIG. 5 is a graph showing the transmission spectrum of the communication device in a case where the radio wave absorption body is attached to the conductive body according to one embodiment of the present invention.

FIG. 5 is a graph showing a transmission spectrum of the communication device that has the constitution of FIGS. 4A and 4B. As shown here, it is possible to reduce oscillation.

Figure 6:
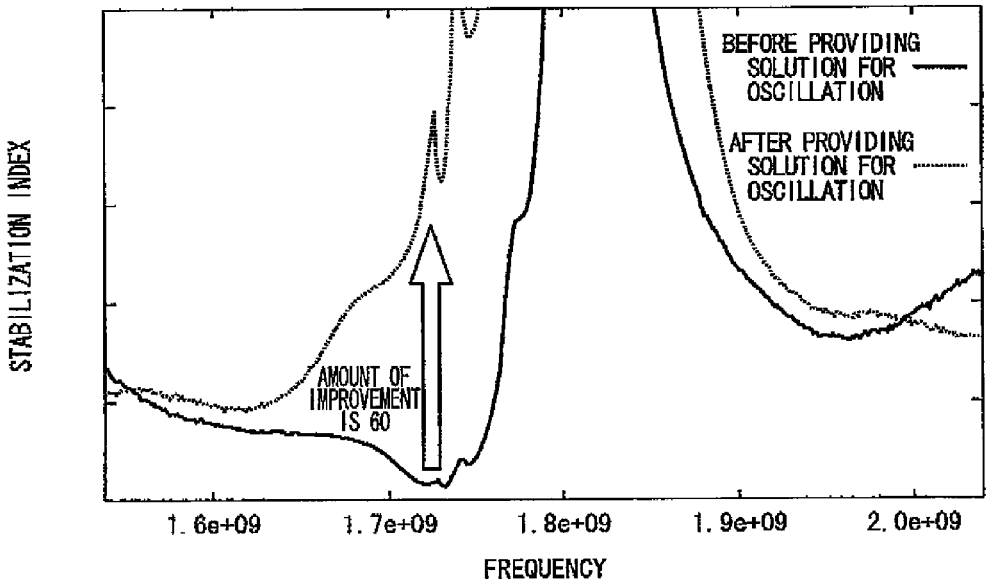
FIG. 6 is a graph showing stability among the chip antenna, an L shape metallic plate and the power amplifier in a case where the radio wave absorption body is attached to the conductive body with regard to the communication device in one embodiment of the present invention.

FIG. 6 is a graph showing a stabilization index among the chip antenna, an L shape metallic plate and the power amplifier of the communication device that has the constitution of FIGS. 4A and 4B. As shown here, it is possible to improve the stabilization index at approximately 1.7 GHz.

As described above, in the communication device of the constitution of FIGS. 4A and 4B, it is possible to improve the receiving ability of the chip antenna by providing the L shape metallic plate 5, and in addition, it is possible to reduce the bad influence caused by providing the L shape metallic plate, that is, oscillation of the power amplifier 9.

It should be noted that in this embodiment, the L shape metallic plate 5 is used as the conductive body, but in a practical implementation, it is possible to apply other shapes, for example, it is supposed that a shape can be applied which is formed by curving a metallic column bar.

In addition, in this embodiment, one example of the communication device is explained which is installed inside the case of the PC card, but in a practical implementation, the communication device can otherwise be such as a mobile terminal.

Second Embodiment

Figure 7:
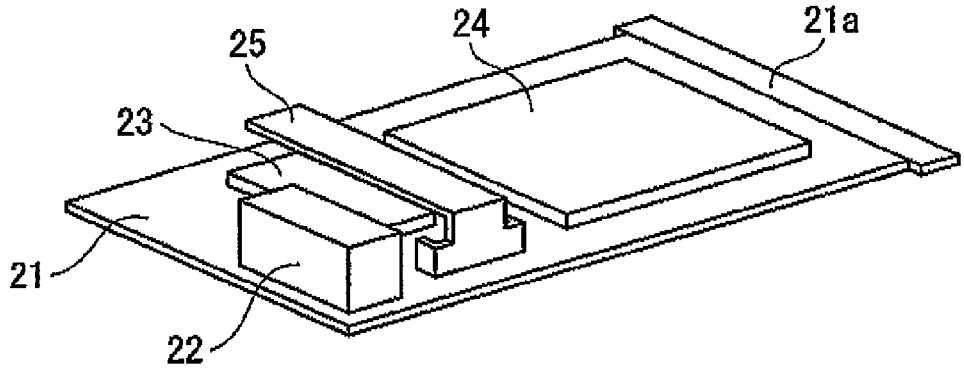
FIG. 7 is a perspective view of the outside of the communication device according to one embodiment of the present invention.

Hereinafter, in reference to FIGS. 7-9, a second embodiment of the present invention is explained. FIG. 7 is a perspective view of the outside of the communication device of this embodiment. The communication device which is used in a state of being installed inside a case of a PC card includes: a printed wiring board 21; a chip antenna 22; an RF circuit portion 23; a digital circuit portion 24; and an L shape metallic plate 25 (conductive body).

The printed wiring board 21 has a connector 21*a* at one end. The connector 21*a* is connected to a connector inside an extended slot of a notebook personal computer.

On the printed board 21, the chip antenna 22, the RF circuit portion 23 and the digital circuit portion 24 are provided in this order from a side of an end opposite to the connector 21*a*. In addition, the printed wiring board 21 has a ground conductive body to which the L shape metallic plate 25 is connected.

The chip antenna 22 is implemented so as to have a lengthwise direction which is substantially orthogonal compared to a direction in which, on the printed wiring board 21, the chip antenna 22, the RF circuit portion 23, and the digital circuit portion 24 are arranged.

The chip antenna 22 catches the received radio wave and outputs the radio wave as the received signal to the RF circuit portion 23, and the chip antenna 22 radiates the transmission signal as the transmission radio wave in the air that is input from the RF circuit portion 23.

The chip antenna 22 has an electric length equals to an ¼ wavelength of the received radio wave or the transmission radio wave.

The RF circuit portion 23 converts the input signal (RF signal) input from the chip antenna 22 to a low frequency and outputs it to the digital circuit portion 24, and the RF circuit portion 23 converts the signal input from the digital circuit portion 24 to the high frequency (to RF signal) and outputs the converted signal to the chip antenna.

The digital circuit portion 24 demodulates the signal input from the RF circuit portion 23 and outputs the signal to the connector 21*a*, and the digital circuit portion 24 modulates the signal input from the connector 21*a* and output the signal to the RF circuit 23.

Figure 8:
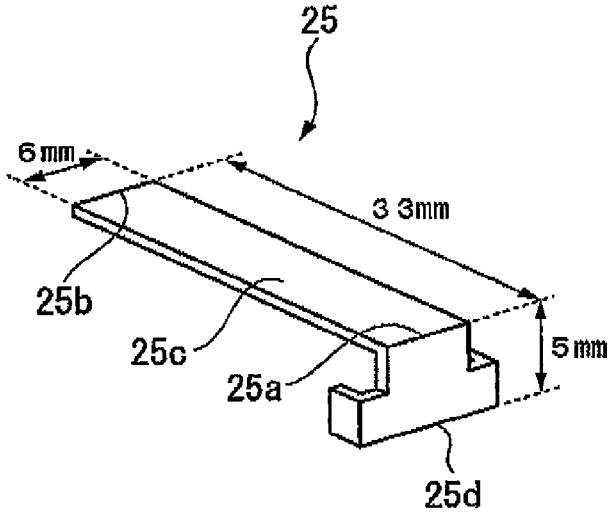
FIG. 8 is a perspective view showing the outside and size of the L shape metallic plate according to one embodiment of the present invention.

The L shape metallic plate 25 has a shape in which a portion close to one end of a metallic member in a strip shape is curved in a substantially orthogonal angle, as shown in FIG. 8, the end portion 25*d* is connected to the ground conductive body while the portion 25*c* which is between the end portion 25*a* apart from the curved portion 25*a* and the curved portion 25*a* is substantially in parallel to the printed wiring board 21, and the other end portion 25*b* is an open end.

The L shape metallic plate 25 has an electric length equals to ¼ of the wavelength of the transmitted/received radio wave. In a case in which the transmission/received frequency of the chip antenna is in a band of 1.79 GHz, the L shape metallic plate 25 has an appropriate shape in which, for example, a width is 6 mm, a length of the portion 25*c* that is a length between the end portion 25*b* which is an open end and the curved portion 25*a* is 33 mm, and a length between the curved portion 25*a* and the end portion 25*d* is 5 mm.

The L shape metallic plate 25 is provided in a manner in which the portion 25*c* between the end portion 25*b* which is the open end and the curved portion 25*a* is extended between the chip antenna 22 and the digital circuit portion 24 while maintaining a height or space from the printed wiring board 21 so as to be 5 mm, and in addition, the length direction of the portion 25*c* is in substantially parallel to the length direction of the chip antenna 22.

Figure 9:
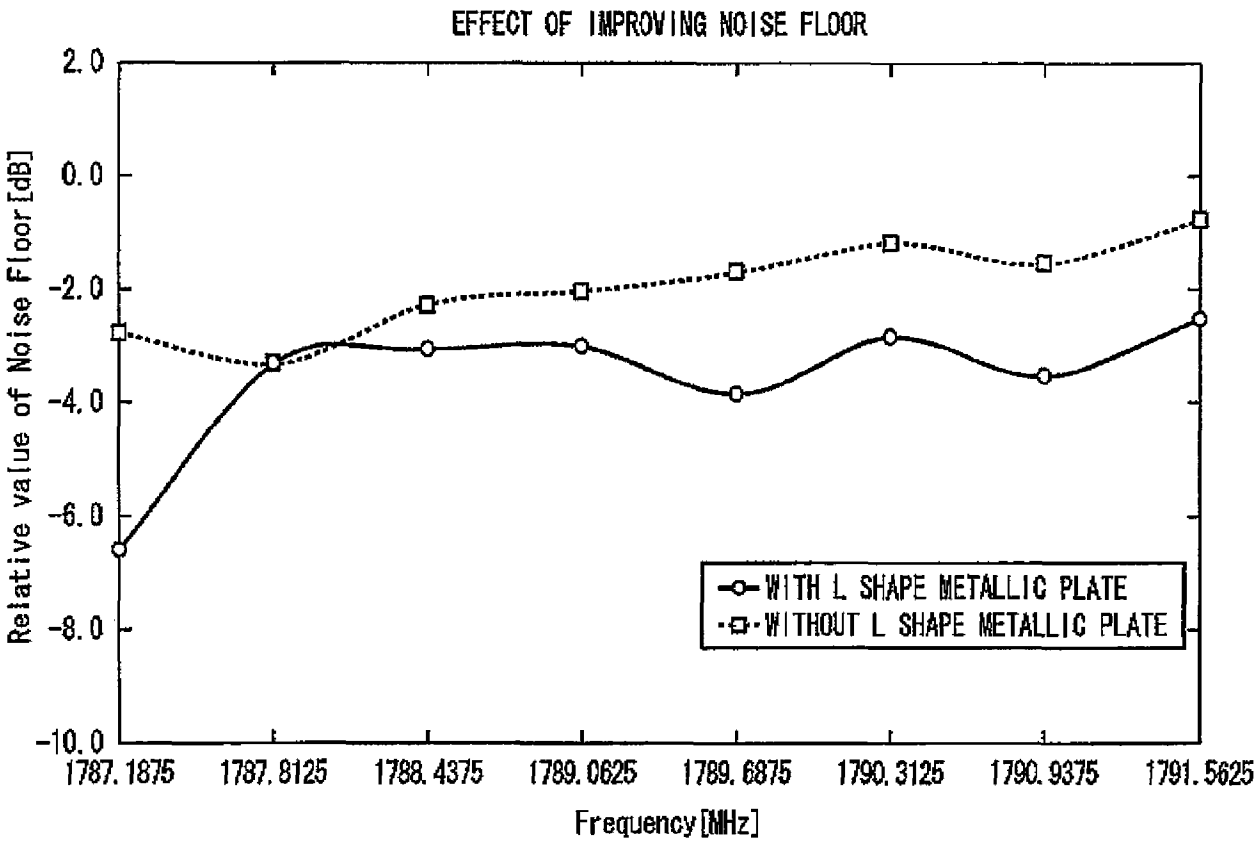
FIG. 9 is a graph showing an improvement of a noise floor of one embodiment of the present invention.

FIG. 9 is a graph showing improvement results of a noise floor after attaching a PC card to a notebook personal computer while the PC card include a communication device of the above-described constitution inside its case. A solid line shows the noise floor in a case of providing the L shape metallic panel 25 in a manner shown in the above-described constitution, and a broken line shows the noise floor in a conventional case in which the L shape metallic panel 25 is not provided.

In accordance with the experiments, without the L shape metallic panel 25, the noise floor fluctuates in a range of approximately −2.0 dB throughout the overall frequency. Compared to this, the noise floor of a case with the L shape metallic panel 25 is 0-4.0 dB lower, and in addition, when providing the L shape metallic panel 25, there is an advantage of a 2 dB improvement in the average. The applicant supposes that the reason for the improved effects is the lower noise caused by changes in distribution of the current on the printed wiring board 21 after attachment of the L shape metallic panel 25.

Therefore, in accordance with the experiments, it is possible to say that the noise floor is improved even when the notebook personal computer is turned on.

As described above, in the communication device, by applying an easy solution with a low cost, that is, by providing the L shape metallic plate 5, it is possible to reduce the bad influence caused by the noise, and it is possible to exclude a factor of deteriorating the receiving ability of the chip antenna.

It should be noted that, in this embodiment, the conductive body is the L shape metallic plate 25, but it is possible to use other shapes in a practical implementation, for example, it is possible to use a curved metallic column bar.

In addition, in this embodiment, an example of the communication device that is installed inside a case of the PC card is explained, but in a practical implementation, the communication device can be a mobile terminal, or the like.

INDUSTRIAL APPLICABILITY

In accordance with the present invention, by attaching the radio wave absorption body to the conductive body, it is possible to avoid oscillation of the power amplifier, hence, without deteriorating the function of reducing bad effects of the noise on the chip antenna, it is possible to avoid a new problem caused by providing the conductive body, that is, oscillation of the power amplifier.

The invention claimed is:

1. A communication device comprising:

a chip antenna which is implemented on a printed wiring board and which catches radio waves of a desired frequency;

an RF circuit which is implemented on the printed wiring board and which converts received signals input from the chip antenna to a low frequency;

a digital circuit which is implemented on the printed wiring board and which demodulates the received signals in a low frequency input from the RF circuit;

a conductive body which is extended between the chip antenna and the digital circuit while being maintained at a certain height from the printed wiring board, which has an end connected to a ground conductive body of the printed wiring board, and which has a space between the conductive body and the printed wiring board; and a radio wave absorption body which is attached to the conductive body.

2. A communication device according to claim 1, wherein the conductive body is constituted from a metallic plate of a strip shape, and the radio wave absorption body has a length of at least 2 mm along a lengthwise direction of the conductive body and has substantially the same length as the width of the conductive body along a width direction of the conductive body.

3. A communication device comprising:

a chip antenna which is implemented on a printed wiring board, which catches radio waves of a desired frequency and which has an electric length of ¼ of wavelength of the radio wave of the desired frequency;

an RF circuit which is implemented on the printed wiring board and which converts received signals input from the chip antenna to a low frequency;

a digital circuit which is implemented on the printed wiring board and which demodulates the received signals in a low frequency input from the RF circuit;

a conductive body which has an electric length of ¼ of the wavelength of the radio wave of the desired frequency, which is extended between the chip antenna and the digital circuit while being maintained at a certain height from the printed wiring board, which has an end connected to a ground conductive body of the printed wiring board, and which has a space between the conductive body and the printed wiring board; and a radio wave absorption body which is attached to the conductive body.

4. A communication device comprising:

a chip antenna which is implemented on a printed wiring board and which catches radio waves of a desired frequency;

an RF circuit which is implemented on the printed wiring board and which amplifies and converts received signals input from the chip antenna to a low frequency;

a digital circuit which is implemented on the printed wiring board and which demodulates the received signals in a low frequency input from the RE circuit; and a conductive body which is extended between the chip antenna and the digital circuit while being maintained at a certain height from the printed wiring board, which has an end connected to a ground conductive body of the printed wiring board, and which has a space between the conductive body and the printed wiring board.

5. A communication device according to claim 4, wherein the conductive body has a substantially L shape constituted from a metallic member in a strip shape, is curved at a position close to one end which is connected to the ground conductive body, and wherein the conductive body has a portion in parallel to the printed wiring body that is between the curved position and the other end which is an open end.

6. A communication device comprising:

a chip antenna which is implemented on a printed wiring board, which catches radio waves of a desired frequency and which has an electric length of ¼ of wavelength of a radio wave of the desired frequency;

an RF circuit which is implemented on the printed wiring board and which amplifies and converts received signals input from the chip antenna to a low frequency;

a digital circuit which is implemented on the printed wiring board and which demodulates the received signals in a low frequency input from the RF circuit; and a conductive body which has an electric length of ¼ of the wavelength of a radio wave of the desired frequency, which is extended between the chip antenna and the digital circuit while being maintained at a certain height from the printed wiring board, which has an end connected to a ground conductive body of the printed wiring board, and which has a space between the conductive body and the printed wiring board.

* * * * *